US008556363B2

(12) United States Patent
Ishihara

(10) Patent No.: US 8,556,363 B2
(45) Date of Patent: Oct. 15, 2013

(54) LIQUID EJECTING APPARATUS

(75) Inventor: Kenichi Ishihara, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 349 days.

(21) Appl. No.: 13/026,849

(22) Filed: Feb. 14, 2011

(65) Prior Publication Data

US 2011/0221813 A1 Sep. 15, 2011

(30) Foreign Application Priority Data

Mar. 11, 2010 (JP) ..... 2010-054102

(51) Int. Cl.
*B41J 29/38* (2006.01)

(52) U.S. Cl.
USPC ..... 347/9

(58) Field of Classification Search
CPC ..... B41J 2/04581; B41J 2/04588
USPC ..... 347/9, 14, 54, 56, 65, 68
See application file for complete search history.

(56) References Cited

U.S. PATENT DOCUMENTS 6,481,833 B1 * 11/2002 Fujii et al. ..... 347/68
7,311,378 B2 * 12/2007 Fujimori et al. ..... 347/33
2008/0049066 A1 2/2008 Inoue

FOREIGN PATENT DOCUMENTS

JP 2008-307708 12/2008
JP 2008-307855 12/2008
JP 2009-274418 11/2009

* cited by examiner

*Primary Examiner* — An Do

(57) ABSTRACT

A liquid ejecting apparatus includes a liquid ejecting head with a plurality of nozzles that eject a liquid to a medium; the liquid ejecting head has actuators (piezoelectric devices), each of which causes an ejection operation for ejecting the liquid from one of the nozzles and a protrusion operation for keeping the liquid protruded from a nozzle plane in which the nozzles are disposed. The liquid ejecting apparatus also includes a controller that identifies non-used nozzles from which not to eject the liquid to the medium to have the protrusion operation performed for the nozzles and also identifies nozzles from which to eject the liquid to have the ejection operation performed for the nozzles.

4 Claims, 6 Drawing Sheets

LIQUID EJECTING APPARATUS

CROSS REFERENCE TO RELATED APPLICATION

The entire disclosure of Japanese Patent Application No. 2010-054102, filed Mar. 11, 2010, is expressly incorporated by reference herein.

BACKGROUND

1. Technical Field

The present invention relates a liquid ejecting apparatus for which countermeasures are taken to prevent liquids from evaporating from nozzles.

2. Related Art

The known liquid ejecting apparatus include an ink jet recording unit (referred to below as a printer) that performs printing by ejecting inks to a recording medium such as printing paper from a recording head (referred to below as a head) used as a liquid ejecting head.

In the printer, an ink is supplied from an ink reservoir such as an ink cartridge or ink tank to an ink chamber in the head. When an actuator, such as a piezoelectric device, provided in the head is driven to increase the pressure of the ink in the ink chamber, the ink is expelled (ejected) from the ink chamber through the opening of a nozzle communicating with the ink chamber.

In this type of printer, the solvent in the ink in the nozzle evaporates through the nozzle opening when power is shut off or the ink is not expelled within a predetermined time. In this case, the viscosity of the ink in the nozzle increases. The nozzle may be clogged with the viscous ink and thereby may fail to expel the ink.

Accordingly, the printer carries out a cleaning process that includes a flushing operation for expelling ink from the nozzle, a suction cleaning operation for forcibly drawing ink from the nozzle, and a sweep cleaning operation for removing ink adhering to a nozzle plane in which the nozzle opening is formed. While no ink is expelled from the nozzle (while power is shut off or the process is not to expel ink), the nozzle plane is covered with a cap member of a capping unit to suppress the solvent in the ink in the nozzle from evaporating.

In the flushing operation, however, which is frequently carried out at periodic intervals, inks are also expelled during printing from nozzles that are not used for the printing, so the amounts of inks used to clean the nozzles not in use during the printing are increased.

Another problem is that even when the nozzle plane is covered with the cap member, a meniscus remains formed in the nozzle and thereby the ink in the nozzle is exposed to the air, according to which the solvent of the ink evaporates through the nozzle opening and the ink in the nozzle easily becomes viscous.

In known methods of preventing an ink from evaporating from a nozzle, an oil is drawn into the nozzle (see JP-A-2009-274418, for example), the nozzle plane is covered with an adhesive layer (see JP-A-2008-307855, for example), and the nozzle is heated to form a drying prevention layer (see JP-A-2008-307708, for example).

In the above methods in which an oil or adhesive, which is a substance other than an ink (a liquid) intended to be ejected, is used, however, the non-ink substance and its storage vessel must be prepared and a specific device to remove the substance from the nozzle plane is also needed. Another problem is that the substance may be mixed with the ink to be ejected. Accordingly, these methods are not practical.

In the method in which the nozzle is heated to form a drying prevention layer, the ink is highly likely to solidify in the nozzle. If the ink solidifies, the solidified ink cannot be ejected by the flushing operation and the suction cleaning operation must be performed, preventing the amount of ink used for nozzle cleaning from being reduced.

SUMMARY

An advantage of some aspects of the invention is to provide a liquid ejecting apparatus that can prevent a liquid to be ejected from evaporating from a nozzle by using the liquid, which is intended to be ejected.

A liquid ejecting apparatus according to an aspect of the invention is a liquid ejecting apparatus that includes a liquid ejecting head with a plurality of nozzles that eject a liquid to a medium; the liquid ejecting head has actuators, each of which causes an ejection operation for ejecting the liquid from one of the nozzles and a protrusion operation for keeping the liquid protruded from a nozzle plane in which the nozzles are disposed. The liquid ejecting apparatus also includes a controller that identifies nozzles from which not to eject the liquid to the medium to have the protrusion operation performed for the nozzles and also identifies nozzles from which to eject the liquid to have the ejection operation performed for the nozzles. Accordingly, it is possible to prevent the liquid from evaporating from the nozzles that do not eject the liquid by using the liquid, which is intended to be ejected, and also possible to reduce the amount of liquid used to clean the nozzles that do not eject the liquid.

A liquid ejecting apparatus according to another aspect of the invention includes the liquid ejecting head and a controller that has the protrusion operation performed for all nozzles after the liquid has been ejected to the medium. Therefore, it is possible to prevent the liquid in all nozzles from evaporating by using the liquid, which is intended to be ejected, after the ejection operation has been completed and also possible to reduce the amount of liquid used to clean all the nozzles.

It is preferable that a nozzle plane sweeper that sweeps out the liquid protruding from the nozzle plane be provided. When a predetermined time has elapsed since the protrusion operation was performed, the controller preferably drives the nozzle plane sweeper. Therefore, after the liquid protruding from the nozzle has been removed, the liquid exposed from the nozzle opening is not so viscous, enabling the amount of liquid used to clean the nozzle to be reduced.

It is preferable that the predetermined time be a time taken until part of the protruding liquid becomes viscous and is solidified. Therefore, when the liquid protruding from the nozzle plane is swept out in a state in which part of the liquid is viscous and is solidified, the liquid protruding from the nozzle plane can be reliably swept out, preventing a case in which the entire protruding liquid cannot be swept out by the sweeper because the liquid has become viscous and has solidified.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
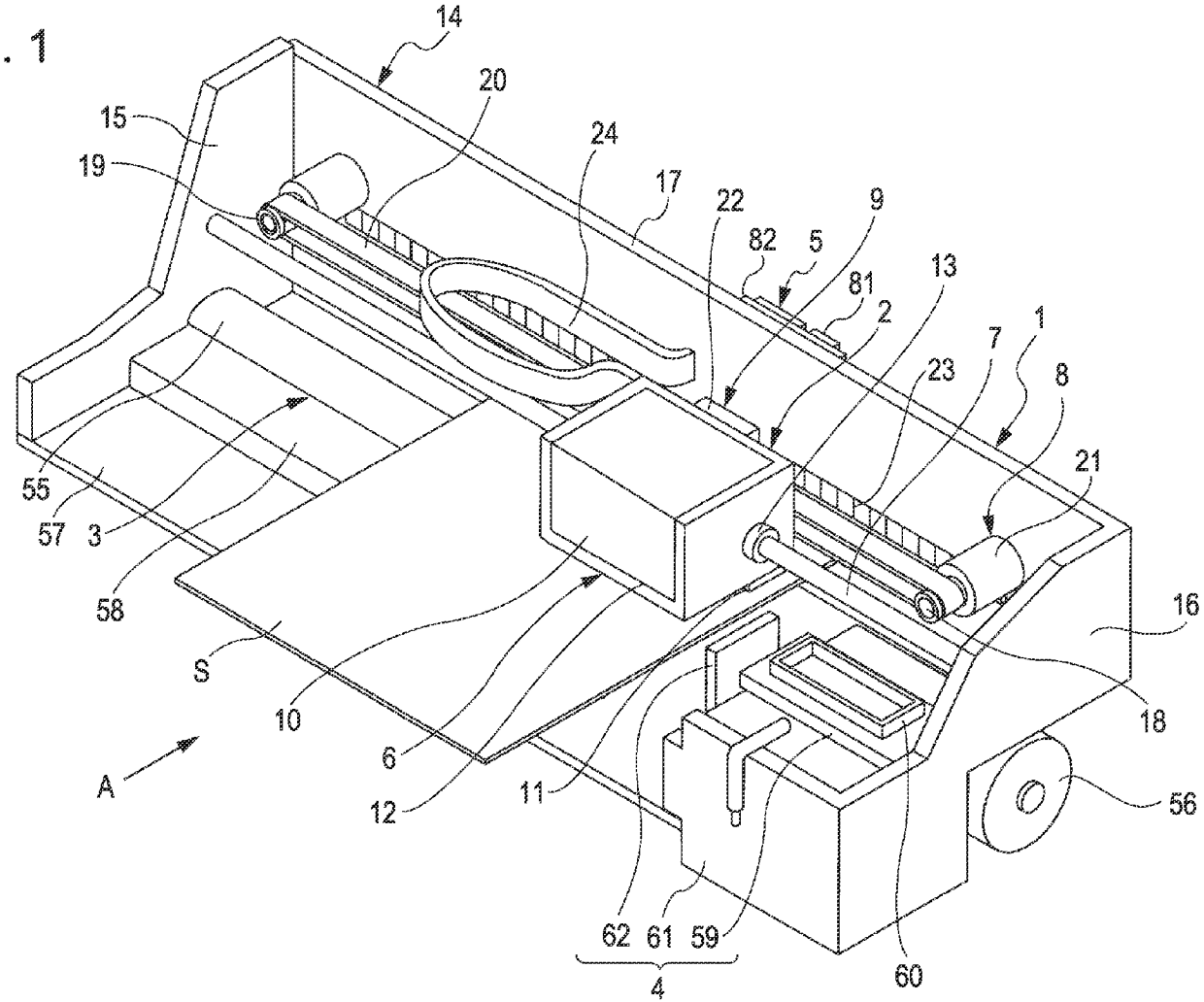
FIG. 1 is a perspective view showing a printer (first embodiment).

The entire structure of a printer according to a first embodiment will be described with reference to FIG. 1. A printer 1 includes a printing unit 2, a recording medium supply unit 3, a cleaner 4, and a controller 5.

In this description, the forward, backward, leftward, rightward, upward, and downward directions are determined when the printer 1 is placed as shown in FIG. 1 and viewed from its front as indicated by the arrow A.

The printing unit 2 includes a carriage 6, a carriage guide 7, a carriage driving mechanism 8, a linear encoder 9, ink cartridges (simply referred to below as the cartridges) 10, and a head 11.

The carriage 6 includes a head mounting portion (not shown), a cartridge mounting portion 12, and a bearing 13. The carriage 6 moves the head 11 and cartridges 10 rightward and leftward (main scanning directions) of the printer 1 along the carriage guide 7, with the head 11 and cartridges 10 mounted.

The carriage guide 7 is formed of a guide shaft that passes through, for example, a bearing hole for the bearing 13 of the carriage 6 and is disposed across a side plate (left side plate) 15 and another side plate (right side plate) 16 at both ends of a case 14, one end (left end) of the guide shaft being linked to the side plate 15 of the case 14, the other end (right end) being linked to the side plate (right end) 16 of the case 14.

The carriage driving mechanism 8 includes a driving pulley 18 disposed on the right of a rear plate 17 of the case 14, a driven pulley 19 disposed on the left of the rear plate 17 of the case 14, a timing belt 20 stretched between the driving pulley 18 and driven pulley 19, and a carriage driving motor 21 used as a driving source for turning the driving pulley. When the output axis of the carriage driving motor 21 is turned in the normal or reverse direction, the timing belt 20 travels to the right and left so as to be reciprocatable.

One of the upper belt and lower belt of the timing belt 20 is linked to the carriage 6. When the output axis of the carriage driving motor 21 is turned in the normal or reverse direction, the carriage 6 including the head 11 and cartridges 10 travels to the right and left so as to be reciprocatable along the carriage guide 7, together with the timing belt 20.

A printing area and a non-printing area outside the printing area are predetermined for the head 11, which can move to the right and left along the carriage guide 7; in the printing area, printing is possible on a recording medium S such as print paper.

The linear encoder 9 includes a linear scale 23 and an encoder substrate 22 on which a photodetector (not shown) is mounted. The encoder substrate 22 is mounted on the carriage 6 (on its rear surface, for example). The linear scale 23 is disposed in front of the rear plate 17 of the case 14 so as to be parallel to the timing belt 20. The encoder substrate 22 and the controller 5 mounted on the rear plate 17 of the case 14 are interconnected by signal lines 24 such as a flat cable. The signal lines 24 are used to transmit and receive signals between the encoder substrate 22 and controller 5. Specifically, the photodetector optically reads a scale on the linear scale 23 to obtain a position signal for the carriage 6, and outputs the position signal to the controller 5. The controller 5 recognizes the position of the carriage 6 from the position signal, and controls a direction in which the carriage 6 moves and an amount by which the carriage 6 moves.

Each cartridge 10, which is removably installed in the cartridge mounting portion 12 of the carriage 6, is structured as a vessel that individually stores an ink, which includes a dye or pigment used as a coloring agent in water used as a solvent, the ink being used for printing in, for example, cyan (C), magenta (M), yellow (Y), or black (K). The cartridge 10 has an ink supply opening (not shown) communicating with the head 11, for each ink vessel. When an ink supply needle (not shown) provided on the carriage 6 is inserted into the ink supply opening, the ink is supplied from the cartridge 10 to the head 11.

Figure 2:
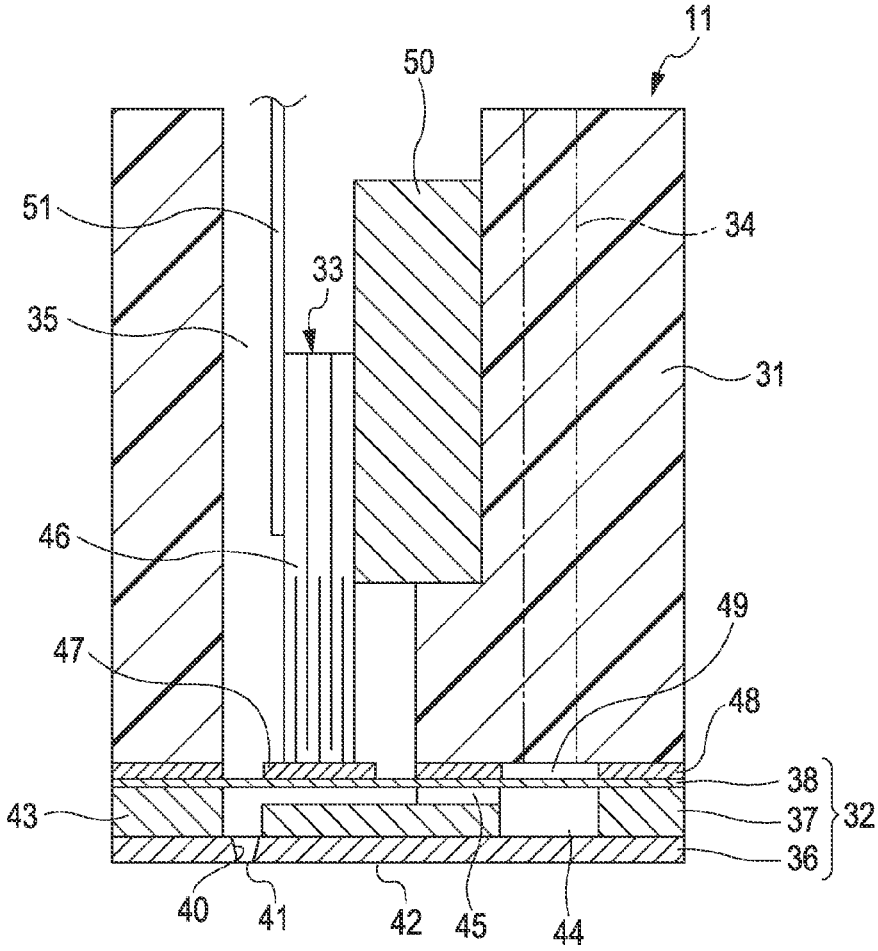
FIG. 2 is a cross sectional view showing the structure of a head (first embodiment).

The head 11 mounted on the carriage 6 includes a head case 31, a flow path forming unit 32, and a driving unit 33, as shown in FIG. 2. In the description that follows, the head 11 is of a type that has vertically vibrating piezoelectric devices 46.

The head case 31 is formed of, for example, a synthetic resin. The head case 31 includes an internal flow path 34, through which an ink is supplied from the cartridge 10 to the flow path forming unit 32, and an accommodating space 35 in which the driving unit 33 is accommodated.

The flow path forming unit 32 is formed by stacking a nozzle substrate 36, a flow path substrate 37, and vibration plate 38, which are mutually bonded with an adhesive.

The nozzle substrate 36 is formed of, for example, a metal such as stainless steel. The nozzle substrate 36 includes a plurality of nozzles 40, 40, . . . disposed in a predetermined direction at predetermined intervals (pitches). Openings 41 are formed as the ink ejecting openings of the nozzles 40 passing through the nozzle substrate 36. A nozzle plane 42 includes the openings 41. The nozzle substrate 36 includes a nozzle string (not shown) for individual colors, which is formed by the plurality of nozzles 40, 40, . . . from which inks in, for example, cyan (C), magenta (M), yellow (Y), and black (K) are expelled.

The flow path substrate 37 is formed by, for example, anisotropically etching a silicon plate. One plane of the flow path substrate 37 is bonded to a plane (which includes a plane including ink receiving openings of the nozzles 40) of the nozzle substrate 36, the plane of the nozzle substrate 36 being opposite to its another plane facing the nozzle plane 42. The other plane of the flow path substrate 37 is bonded to one plane of the vibration plate 38. Then, individual ink chambers (liquid chambers) 43, 43, . . . individually communicating with the nozzles 40, 40, . . . , a common ink chamber 44 communicating with the internal flow path 34, and individual ink supply paths 45, 45, . . . through which the individual ink chambers 43, 43, . . . individually communicate with the common ink chamber 44 are formed.

The vibration plate 38 is formed by laminating an elastic film on a metallic support plate made of, for example, stainless steel. One plane of the vibration plate 38 is bonded to the other plane of the flow path substrate 37.

On the other plane of the vibration plate 38, an island 47 bonded to one ends of the piezoelectric devices 46 is formed at a place corresponding to each individual ink chamber 43.

The vibration plate 38, which defines the individual ink chamber 43, is elastically deformed in response to the driving of the piezoelectric device 46.

The other plane of the vibration plate 38 and the head case 31 are mutually linked through a linkage plate 48. A compliance portion 49, which reduces a pressure change in the common ink chamber 44, is formed between the vibration plate 38 and an end of the internal flow path 34.

The driving unit 33 includes a plurality of piezoelectric devices 46, 46, . . . and a fixing member 50 supporting the other ends of the piezoelectric devices 46, and signal lines 51 through which driving signals are sent to the piezoelectric devices 46.

When the cartridges 10 are installed in the carriage 6, the ink in the cartridges 10 is supplied to the common ink chamber 44 through the internal flow path 34. The ink supplied to the common ink chamber 44 is distributed to the plurality of individual ink chambers 43 through the individual ink supply paths 45.

When a driving signal is applied to the piezoelectric device 46, the piezoelectric device 46 contracts and expands and the vibration plate 38 deforms in directions toward and away from the nozzle substrate 36. The volume of the individual ink chamber 43 changes accordingly and the pressure in the individual ink chamber 43 varies. This variation in ink pressure causes the ink to be expelled from the opening 41 of the nozzle 40.

As shown in FIG. 1, the recording medium supply unit 3 includes an insertion slot (not shown) into which the recording medium S placed on a supply tray (not shown) is inserted, an intake roller (not shown) that supplies the recording medium S placed on the supply tray into the printer 1, a transport roller 55 that transports the supplied recording medium S to a position where it faces the nozzle plane 42 of the head 11, and an ejection roller (not shown) that ejects the recording medium S for which printing has been completed because the inks expelled from the nozzles have been applied to the paper surface. The intake roller, transport roller 55, and ejection roller are driven by a roller driving motor 56 through gears (not shown). A platen 58 is provided on the inner bottom surface 57 of the case 14 along the carriage guide 7. The recording medium S is transported on the platen 58.

The cleaner 4 includes a capper 59, a suction pump 61, which is used as a suction unit, and a nozzle plane sweeper 62.

The capper 59 is disposed at a position where it faces the nozzle plane 42 of the head 11 when the head 11, which is movable to the right and left along the carriage guide 7, is located in the non-printing area.

The capper 59 includes a cap member 60 and a cap member driving mechanism (not shown) that moves the cap member 60.

Figure 3:
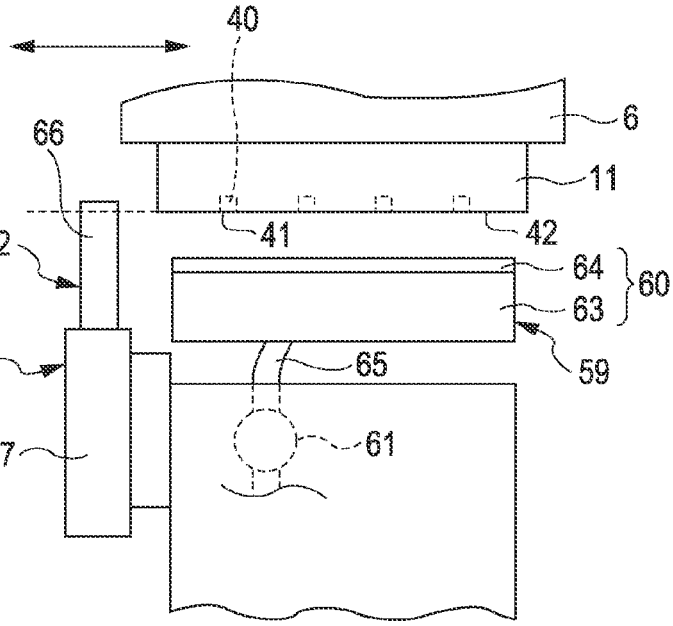
FIG. 3 shows a capping unit and nozzle plane sweeper (first embodiment).

As shown in FIG. 3, the cap member 60 includes a closed bottom case 63, which is substantially a rectangular parallelepiped with an open top, for example, and a sealing member 64 provided along the open edges of the closed bottom case 63. The sealing member 64 is formed of an insulating material having superior adhesion to the nozzle plane 42, such as, for example, silicone rubber.

The closed bottom case 63 of the cap member 60 has, at the bottom, a through-hole (not shown) used for suction and another through-hole (not shown) that is open to the atmosphere.

The through hole used for suction is connected to the suction side of the suction pump 61 through a suction pipe 65 like a tube, so as to be communicatable. Accordingly, a suction cleaning unit is structured by the capper 59 and suction pump 61 as well as the controller 5, which controls their driving.

An opening path (not shown) is connected to the through-hole open to the atmosphere so as to be communicatable. The opening path has an opening valve (not shown) that opens and closes the open path.

The capper 59 is structured so as to be switchable by the cap member driving mechanism between a state in which the capper 59 seals the nozzle plane 42 and another state in which the capper 59 is separated from the nozzle plane 42. In the state in which the nozzle plane 42 is sealed, when the sealing member 64 comes into contact with the nozzle plane 42 so as to enclose the openings 41, 41, . . . of all the nozzles 40, 40, . . . on the nozzle plane 42, a sealed space in which all the nozzles 40, 40, . . . are shut off from the outside is formed by being enclosed by the inner bottom surface of the closed bottom case 63, the sealing member 64, and the nozzle plane 42. When the suction pump 61 is driven with the opening valve closed, negative pressure develops in the sealed space and thereby the ink in each nozzle 40 is forcibly drawn. If the ink in the nozzle 40 is periodically drawn in this way, suction cleaning for preventing expelling failures due to nozzle clogging or another cause is performed. The ink drawn by the suction pump 61 is discharged into a waste water tank through a discharge pipe (not shown) connected to the expelling side of the suction pump 61, and is absorbed into a waste water absorbing material provided in the waste water tank.

To release the sealing of the nozzles 40 effected by the capper 59, the suction pump 61 is stopped and the opening valve is opened, after which the cap member driving mechanism is driven to separate the capper 59 from the nozzle plane 42.

A moisture retaining agent (not shown) is provided on the inner bottom surface of the closed bottom case 63. The cap member 60 is used to seal the nozzles 40 to prevent the inks in the nozzles 40 from drying during, for example, a halt of printing. The cap member 60 is also used to accept the inks expelled by the nozzles 40 during a flushing operation.

The nozzle plane sweeper 62 such as a wiping unit removes ink remaining on the nozzle plane 42 of the head 11. The nozzle plane sweeper 62 is disposed at a position where it faces the nozzle plane 42 of the head 11 when the head 11 is located in the non-printing area, such as a position adjacent to the capper 59.

As shown in FIG. 3, the nozzle plane sweeper 62 includes a sweeping body 66, which is made of an elastic material such as a rubber plate and a textile material, a base 67 on which the sweeping body 66 is fixed, and a sweeping body driving mechanism (not shown) for moving the sweeping body 66.

In the sweep cleaning by the nozzle plane sweeper 62, the sweeping body driving mechanism is driven to move the sweeping body 66 to a position where the sweeping body 66 can be brought into contact with the nozzle plane 42 of the head 11, after which the carriage 6 is moved toward the sweeping body 66. Then, the sweeping body 66 sweeps the ink remaining on the nozzle plane 42 of the head 11, so the ink remaining on the nozzle plane 42 can be superiorly removed.

Figure 4A:
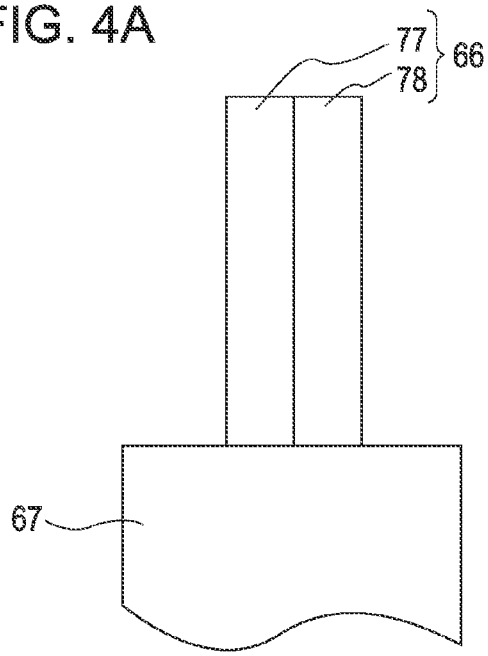
FIGS. 4A and 4B show other exemplary nozzle plane sweepers (first embodiment).

The sweeping body 66 may be structured by mutually bonding the surface of a first sweeping body 77 made of an elastic material such as a rubber plate and the surface of a second sweeping body 78 formed of a sheet, as shown in FIG. 4A, the sheet being made of a ultra fine fiber material by which relatively highly viscous ink or solidified ink can be removed from the nozzle plane 42. For example, the second sweeping body 78 may be a sheet made of fascicles of 0.1 or less denier fibers.

Figure 4B:
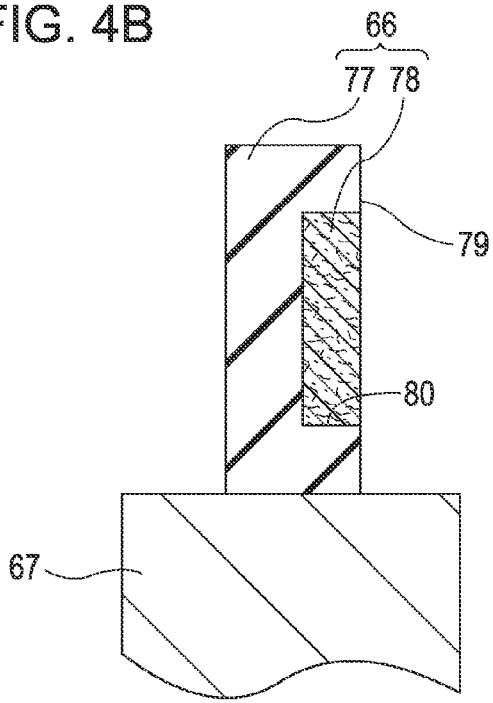

Alternatively, the sweeping body 66 may be structured so that the second sweeping body 78 is embedded in a recess 80 formed in a side 79 of the first sweeping body 77, as shown in FIG. 4B.

If the sweeping body 66 having the second sweeping body 78 as shown in FIG. 4A or 4B is used, ink that could not be removed by the first sweeping body 77 and remains on the nozzle plane 42 can be superiorly removed by the second sweeping body 78.

When the sweeping body 66 shown in FIG. 4A or 4B is used, the controller 5 may control the position of the sweeping body 66 and the direction in which the carriage 6 travels so that the second sweeping body 78 comes into contact with the nozzle plane 42.

The controller 5 is formed by a so-called microprocessor, which includes a ROM in which various types of processing programs are stored, a RAM in which data is saved or temporarily stored, an interface through which information is sent or received to and from a host computer, a CPU, an oscillation circuit, a timer, and other components.

Figure 5:
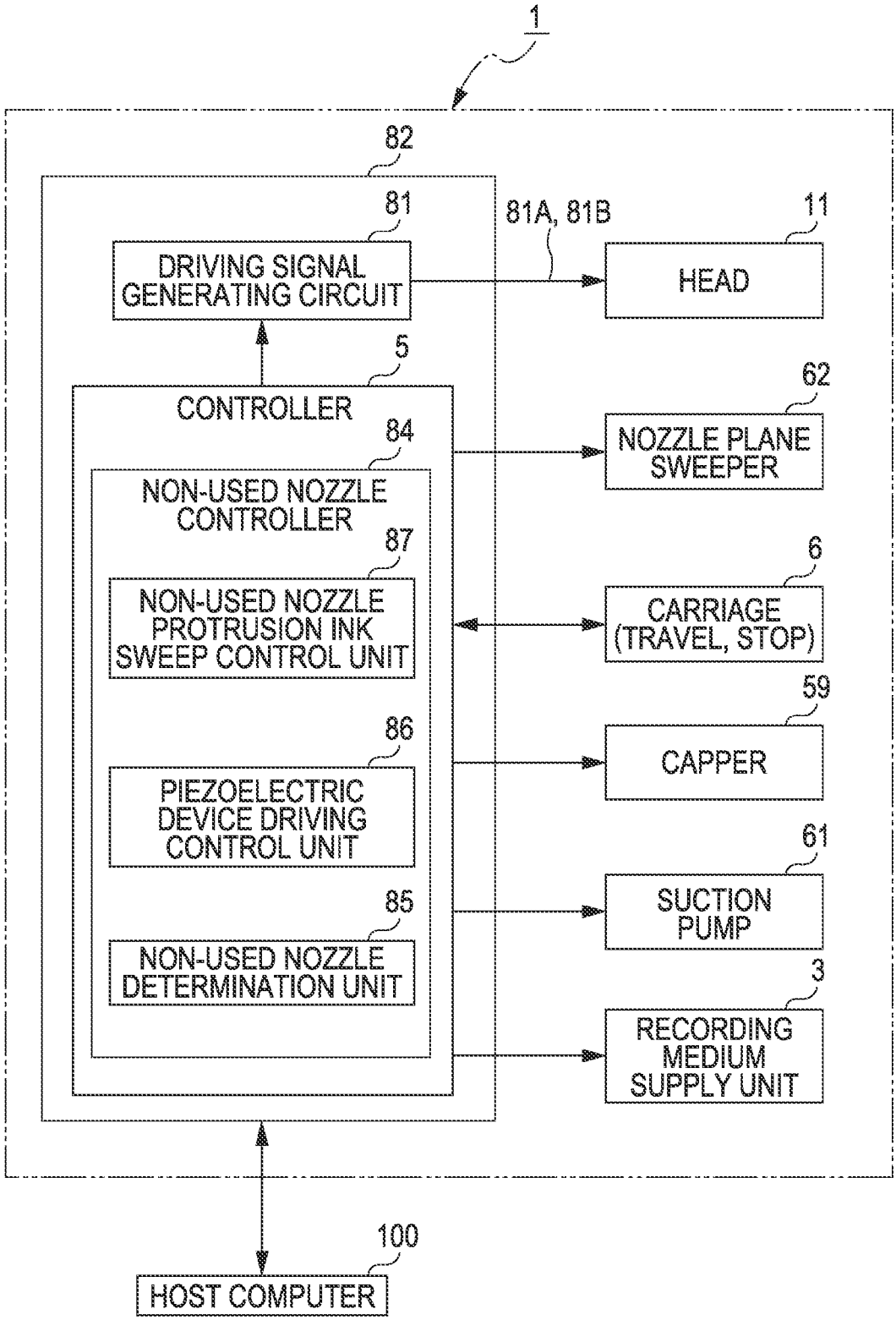
FIG. 5 is a block diagram showing a control structure (first embodiment).

As shown in FIGS. 1 and 5, the controller 5 and a driving signal generating circuit 81 are disposed on a main substrate 82. The main substrate 82 is attached to, for example, the case 14.

The driving signal generating circuit 81 is formed by, for example, a D/A converter that generates analog voltage waveforms used as driving signals in response to clock signals.

The controller 5 and driving signal generating circuit 81 on the main substrate 82 are interconnected by signal lines (not shown) formed on the main substrate 82. A piezoelectric device control substrate (not shown) provided in the head 11 and the driving signal generating circuit 81 are interconnected by signal lines 24.

Figure 6:
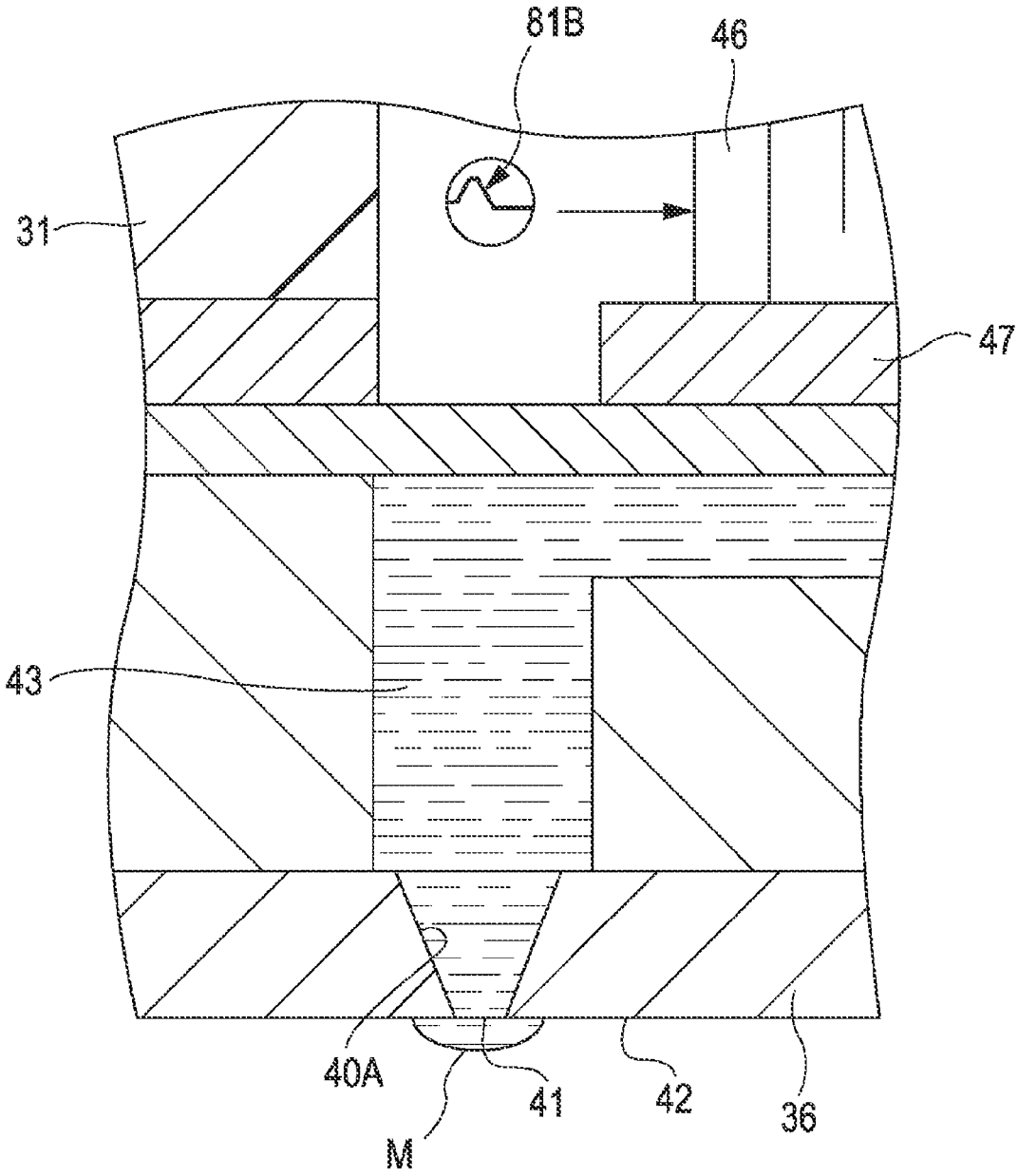
FIG. 6 is a cross sectional view of a drying prevention protrusion (first embodiment).

In the first embodiment, if a nozzle is not used for a predetermined time, described later, or more during printing (the nozzle will be referred to below as the non-used nozzle 40A), the ink end surface on the non-used nozzle 40A is controlled so that the ink end surface protrudes from the nozzle plane 42 through the opening 41 of the nozzle and covers the opening 41 without coming into contact with the edges of the openings 41 of the adjacent nozzles (the protrusion will be referred to below as the drying prevention protrusion M), as shown in FIG. 6.

When the ink end surface on the non-used nozzle 40A is formed so as to be the drying prevention protrusion M as described above, it is possible to prevent the solvent in the ink in the non-used nozzle 40A from evaporating during printing.

Figure 7A:
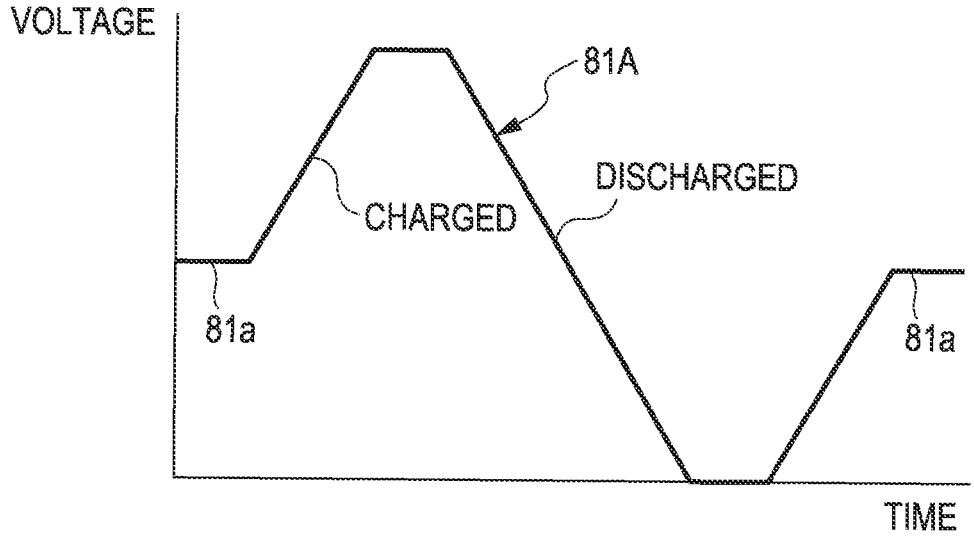
FIG. 7A shows a normal driving signal and FIG. 7B shows a specific driving signal (first embodiment).

A normal driving signal 81A with a voltage waveform as shown in FIG. 7A is applied to the piezoelectric device 46 for the nozzle 40 used during printing. An intermediate potential 81*a* is first applied to the piezoelectric device 46 to place the piezoelectric device 46 in a standby state. When the piezoelectric device 46 is charged and contracts with respect to the standby state, the individual ink chamber 43 expands and its internal pressure drops. Then, the ink in the common ink chamber 44 is supplied into the individual ink chamber 43 through the relevant ink supply path 45. When the piezoelectric device 46 is discharged and expands with respect to the standby state, the individual ink chamber 43 contracts and its internal pressure rises, the ink in the individual ink chamber 43 is expelled through the nozzle 40. After the piezoelectric device 46 is discharged, an intermediate potential 81*a* is applied again to the piezoelectric device 46 to place it in the standby state. When the normal driving signal 81A, which applies an intermediate potential 81*a*, causes charging and discharging, and then applies an intermediate potential 81*a* again, is repeatedly applied to the piezoelectric device 46 as described above, the nozzle 40 used during printing expels ink and a printing process is performed.

Figure 7B:
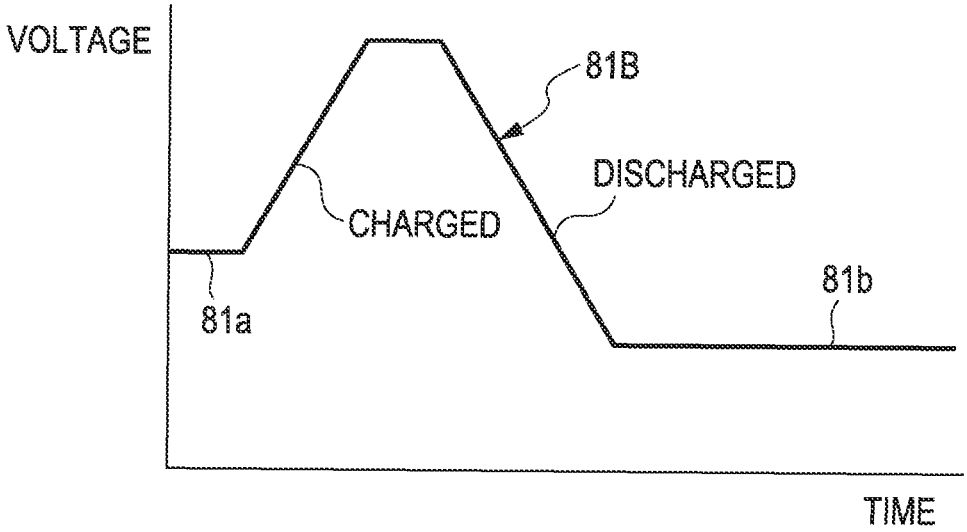

A specific driving signal 81B with a voltage waveform as shown in FIG. 7B is applied to the piezoelectric device 46 for the non-used nozzle 40A, which is not used during printing. An intermediate potential 81*a* is first applied to the piezoelectric device 46 to place the piezoelectric device 46 in the standby state. When the piezoelectric device 46 is charged, it contracts with respect to the standby state. In this case, since the amount of charge is small (about one-third, compared with FIG. 7A), the amount of ink supplied to the individual ink chamber 43 is also small. Furthermore, since an amount by which the voltage charged to the piezoelectric device 46 is discharged is also smaller than in FIG. 7A, the ink in the individual ink chamber 43 protrudes without being expelled through the nozzle 40. Specifically, when the ink end plane on the non-used nozzle 40A forms the drying prevention protrusion M, the above discharge operation is terminated and the specific driving signal 81B, which maintains a potential 81*b* at the time of the termination, is applied to the piezoelectric device 46, forming the drying prevention protrusion M on the opening 41 of the non-used nozzle 40A. If the drying prevention protrusion M is not drawn into the nozzle even when an intermediate potential is applied to the piezoelectric device 46 after the discharge, the intermediate potential may be maintained instead of maintaining the discharged state.

The controller 5 controls units as shown in FIG. 5. Specifically, since the controller 5 and encoder substrate are interconnected with the signal lines 24 and the controller 5 and carriage driving motor 21 are interconnected with signal lines (not shown), the position of the carriage 6 is controlled during printing and cleaning. Since the controller 5 and a driving source (not shown) such as the motor of the sweeping body driving mechanism are interconnected with signal lines (not shown), the driving of the sweeping body 66 is controlled. Since the controller 5 and a driving source (not shown) such as the motor of the cap member driving mechanism are interconnected with signal lines (not shown), the driving of the cap member 60 is controlled. Since the controller 5 and suction pump 61 are interconnected with signal lines (not shown), the driving of the suction pump 61 is controlled. Since the controller 5 and the roller driving motor 56 of the recording medium supply unit 3 are interconnected with signal lines (not shown), the driving of the rollers of the recording medium supply unit 3 is controlled.

The controller 5 further has a non-used nozzle controller 84 as shown in FIG. 5. The non-used nozzle controller 84 includes a non-used nozzle determination unit 85 implemented by a non-used nozzle determination program and by a CPU or the like, which executes a non-used nozzle determination process according to the procedure of the non-used nozzle determination program, a piezoelectric device driving control unit 86 implemented by a piezoelectric device driving control program and by a CPU or the like, which executes a piezoelectric device driving control process according to the procedure of the piezoelectric device driving control program, and a non-used nozzle protrusion ink sweep control unit 87 implemented by a non-used nozzle protrusion ink sweep control program and by a CPU or the like, which executes a non-used nozzle protrusion ink sweep control process according to and the procedure of the non-used nozzle protrusion ink sweep control program.

The non-used nozzle determination unit 85 determines whether there is a non-used nozzle 40A for which a drying prevention protrusion M needs to be formed in the printing process, on the basis of print data sent from a host computer 100. For example, the non-used nozzle determination unit 85 determines whether the printing process specified on the basis of the print data is such that black printing is performed for a predetermined time or more by using only the black ink or whether the printing process is such that the same printing is performed by a specified number of times or more.

The piezoelectric device driving control unit 86 receives information as to whether there are non-used nozzles 40A, from the non-used nozzle determination unit 85. If the piezoelectric device driving control unit 86 recognizes that there are non-used nozzles 40A, the piezoelectric device driving control unit 86 commands the driving signal generating circuit 81 to output the specific driving signal 81B to the non-used nozzles 40A and also output the normal driving signal 81A to the nozzles 40 other than the non-used nozzles 40A. Then, if the printing process is such that black printing is performed for a predetermined time or more, for example, the specific driving signal 81B is applied to the piezoelectric devices 46 for the color-ink nozzles, which are effected as non-used nozzles 40A, and the normal driving signal 81A is applied to the black-ink nozzle 40 used in the back printing. If the printing process is such that the same printing is performed by a large amount, the specific driving signal 81B is applied to the piezoelectric devices 46 for the non-used nozzles 40A, which are not used in the printing, through the piezoelectric device driving control substrate, and the normal driving signal 81A is applied to the nozzles 40 that are used in the printing.

The non-used nozzle protrusion ink sweep control unit 87 sets a timer that starts to measure the predetermined time at the time when the 86 gives the driving signal generating circuit 81 a command to output the specific driving signal 81B. Upon receipt of a time-out signal, indicating that the predetermined time has elapsed, from the timer, the non-used nozzle protrusion ink sweep control unit 87 controls the driving of the nozzle plane sweeper 62 and carriage 6 to remove ink protrusions protruding from the non-used nozzles, which have been formed after the drying prevention protrusions M had become viscous. In other words, upon receipt of a time-out signal, indicating that the predetermined time has elapsed since the drying prevention protrusion M protruding from the nozzle plane 42 was formed, the non-used nozzle protrusion ink sweep control unit 87 controls the driving of the nozzle plane sweeper 62 and carriage 6 to have the sweeping body 66 wipe the nozzle plane 42.

The above predetermined time may be determined with reference to, for example, a particular ink that would be solidified in the shortest time among the inks usable by the printer 1. For example, a particular ink may be used to form a drying prevention protrusion M on the nozzle, after which a time lasting until the solidified ink of the drying prevention protrusion M can no longer be removed with the sweeping body 66 of the nozzle plane sweeper 62 may be experimentally obtained. According to the experimental result, a time during which the drying prevention protrusion M can be reliably removed with the sweeping body 66 of the nozzle plane sweeper 62 may be determined as the predetermined time. If the entire drying prevention protrusion M is solidified, it cannot be swept out with the sweeping body 66, so the predetermined time should be a time at which part of the drying prevention protrusion M becomes viscous and is solidified. If the predetermined time is long, the number of sweeps by the sweeping body 66 of the nozzle plane sweeper 62 can be reduced. If the predetermined time is short, the solidified ink of the drying prevention protrusion M can be more reliably removed.

Operation of the printer 1 according to the first embodiment will be described. When print data is sent from the host computer 100 to the controller 5, the non-used nozzle determination unit 85 determines, on the basis of print data, whether there is a non-used nozzle 40A for which a drying prevention protrusion M needs to be formed in the printing process and sends the determination result to the piezoelectric device driving control unit 86. If the piezoelectric device driving control unit 86 confirms from the determination result that there are non-used nozzles 40A, the piezoelectric device driving control unit 86 commands the driving signal generating circuit 81 to output the specific driving signal 81B to the non-used nozzles 40A and also output the normal driving signal 81A to the nozzles 40 other than the non-used nozzles 40A. Then, the specific driving signal 81B is applied to the piezoelectric devices 46 for the non-used nozzles 40A, forming a drying prevention protrusion M on the opening 41 of each non-used nozzle 40A. When the normal driving signal 81A is applied to the piezoelectric devices 46 of the nozzles 40 in use, ink droplets expelled from the nozzles 40 are applied to the recording paper S.

When the drying prevention protrusion M is formed over the opening 41 of the non-used nozzle 40A as described above, the ink of the drying prevention protrusion M protruding from the nozzle plane 42 continues to dry, starting from the outer side. Then, the opening 41 of the non-used nozzle 40A is placed in a state as if the opening 41 were covered with an ink lid protruding from the nozzle plane 42, preventing the ink in the non-used nozzle 40A from being exposed to the atmosphere. Accordingly, it becomes possible to prevent the solvent of the ink in the non-used nozzle 40A from evaporating, so solidification of the ink in the non-used nozzle 40A can be prevented.

When the non-used nozzle protrusion ink sweep control unit 87 confirms from the timer that the predetermined time has elapsed since the specific driving signal 81B was output to the piezoelectric device 46 for the non-used nozzle 40A, the non-used nozzle protrusion ink sweep control unit 87 controls the driving of the nozzle plane sweeper 62 and carriage 6 to have the sweeping body 66 wipe out the ink on the nozzle plane 42. Then, the ink, in which the drying prevention protrusion M has become viscous, can be removed by the sweeping body 66 of the nozzle plane sweeper 62. Each nozzle 40 in use internally has a meniscus like a recess. Since the sweeping body 66 does not come into contact with the meniscus, there is no effect by the sweep.

The flushing operation is periodically performed only for the nozzles 40 other than the non-used nozzles 40A from when the drying prevention protrusion M is formed over the opening 41 of each non-used nozzle 40A until the viscous ink of the drying prevention protrusion M is removed.

That is, the controller 5 moves the carriage 6 to a position where it faces the cap member 60, and the piezoelectric device driving control unit 86 commands the driving signal generating circuit 81 to supply the specific driving signal 81B only to the piezoelectric devices 46 for the nozzles 40 other than the non-used nozzles 40A. Then, the flushing operation is performed only for the nozzles 40 other than the non-used nozzles 40A.

After the viscous ink of the drying prevention protrusion M has been removed, a driving signal for flushing is output to the piezoelectric devices 46 for all nozzles 40 so that the flushing operation is performed for the nozzles 40.

In the first embodiment, since a drying prevention protrusion M is formed in the opening 41 of each non-used nozzle 40A, it is possible to prevent the solvent in the ink in the non-used nozzle 40A from evaporating during a printing operation.

In the first embodiment, since the viscous ink of the drying prevention protrusion M is removed by the sweeping body 66 of the nozzle plane sweeper 62, ink exposed from the opening 41 of the non-used nozzle 40A is not so viscous. When the non-used nozzle 40A is returned to a normal state, therefore, it suffices to perform the flushing operation just by expelling the not so viscous ink protruding from the opening 41 of the non-used nozzle 40A. This reduces the amount of ink consumed for nozzle cleaning.

In the first embodiment, it is only necessary to use an ink intended to be ejected and to control the piezoelectric device 46 used as the actuator that has the nozzle expel the ink, so the structure of the apparatus can be made simpler than a structure in which a non-ink substance is used to seal the nozzle. It is also possible to prevent the non-ink substance and the ink from being mixed together.

In the first embodiment, the drying prevention protrusion M can be formed for each nozzle and thereby the drying prevention protrusion M can be formed only over the openings of the nozzles that need the drying prevention protrusion M, simplifying an operation to remove the drying prevention protrusion M. This reduces the amount of ink consumed to clean the nozzle before the nozzle is returned to the normal state.

In the first embodiment, from when the drying prevention protrusion M is formed over the opening 41 of each non-used nozzle 40A until the viscous ink of the drying prevention protrusion M is removed, the flushing operation is periodically performed only for the nozzles 40 other than the non-used nozzles 40A, so the amount of ink consumed during the flushing operation can be reduced.

Second Embodiment

The printer 1 may be structured so that the drying prevention protrusion M is formed over the openings 41 of all nozzles 40 after printing is completed, instead of forming the drying prevention protrusion M over the openings 41 of the non-used nozzles 40A, which are not used during printing. Conventionally, to suppress the evaporation of the ink from the nozzle opening 41, the nozzle plane 42 has been sealed by the capper 59. However, since air is present in the cap member 60 as well and the gas permeability of the cap member 60 cannot be completely eliminated, evaporation of the ink could not be prevented. To reduce the number of chances the ink in the nozzle 40 comes into contact with the air, the drying prevention protrusion M is formed or the capper 59 is further used to seal the nozzle plane 42 after the drying prevention protrusion M has been formed. The viscous ink of the drying prevention protrusion M is removed by the sweeping body 66 of the nozzle plane sweeper 62 and then the flushing operation is performed for all nozzles 40 from which the drying prevention protrusion M has been removed before printing starts.

In the second embodiment, it is possible to prevent evaporation of the solvent of the ink from all nozzles 40 that have finished printing, as in the first embodiment. Furthermore, after the viscous ink of the dying prevention protrusion M has been removed from the opening 41 of the nozzle 40, ink exposed therefrom is not so viscous, so the amount of ink consumed for nozzle cleaning cab be reduced when the non-used nozzle 40A is returned to the normal state.

If, in the second embodiment, printing is not performed for a long period of time after the previous printing has been completed, the ink of the drying prevention protrusion M protruding from the opening 41 of the nozzle 40 may be solidified. Therefore, the nozzle plane sweeper 62 preferably includes a sweeping body having a function that can superiorly remove solidified ink. For example, a sweeping body structured so as to scratch off (cut off) solidified ink protruding from the nozzle plane 42 is preferably used.

The head may be a type that causes flexural vibration, instead of vertical vibration as described above. Alternatively, the head may have a heat generating resistor (such as a heater) in the ink chamber to convert electricity to heat. That is, instead of the head in which the piezoelectric device 46 used as the actuator is deformed to pressurize ink, a head in which bubbles are used to pressurize the ink may be used, the bubbles being generated by applying a voltage to a heat generating resistor used as the actuator to heat the ink.

Although the above embodiments have been described by using the ink jet printer as an example, a liquid ejecting apparatus that ejects or expels a non-ink liquid and a liquid vessel including the liquid may be used. These embodiments can also be applied to various types of liquid ejecting apparatus including, for example, a liquid ejecting head that expels a small amount of liquid droplets. The droplets, which are expelled from the liquid ejecting apparatus in the form of a liquid, include granular droplets, eyedrop-like droplets, and filiform droplets. The liquid used here may be a material that the liquid ejecting apparatus can eject. For example, a liquid-phase substance may be used; applicable liquids include substances in a liquid state with high or low viscosity, and flowable substances such as inorganic solvents including sols and gel water, organic solvents, solutions, liquid resins, and liquid metals (metal melts). In addition to liquids, which are in one state of substances, the applicable liquids include substances in which particles of functional materials formed from solids such as pigments and metal particles are solved, dispersed, or mixed in a solvent. Typical exemplary liquids include inks as described in the above embodiments and liquid crystals. Inks applicable here include ordinary water-based inks and oil-based inks as described in the above embodiments as well as inks including various types liquid compositions such as gel inks and hot melt inks. Specific examples of the liquid ejecting apparatus include: for example, liquid ejecting apparatus that eject liquids including distributed or dissolved electrode materials, color materials, and other materials used in the manufacturing of liquid crystal displays, electro-luminescent (EL) displays, surface emitting displays, and color filters; liquid ejecting apparatus that eject bio-organic substances used in bio-chip manufacturing; liquid ejecting apparatus that eject liquids used as precise pipettes to eject liquid samples; printing apparatus; and micro-dispensers. Furthermore, the following liquid ejecting apparatus may be used: liquid ejecting apparatus that pinpoint locations to which to eject lubricants in watches, cameras, and other precise machines; liquid ejecting apparatus that eject transparent resin liquids, such as ultraviolet curable resins, to substrates to form, for example, minute hemispheric lenses used in optical communication devices and the like; and liquid ejecting apparatus that eject etching liquids such as acids or alkalis. Any one of these liquid ejecting apparatus can be applied to the embodiments of the invention.

What is claimed is:

1. A liquid ejecting apparatus including a liquid ejecting head with a plurality of nozzles that eject a liquid to a medium, the liquid ejecting apparatus comprising:

actuators disposed in the head, each of which causes an ejection operation for ejecting the liquid from one of the nozzles and a protrusion operation for keeping the liquid protruded from a nozzle plane in which the nozzles are disposed; and a controller identifying a nozzle which does not eject the liquid and a nozzle which ejects the liquid to the medium, wherein the controller causes the protrusion operation to be performed on the nozzle which does not eject the liquid and causes the ejection operation to be performed on the nozzle which ejects the liquid.

2. The liquid ejecting apparatus according to claim 1, further comprising a nozzle plane sweeper that sweeps out the liquid protruding from the nozzle plane, wherein:

when a predetermined time has elapsed since the protrusion operation was performed, the controller drives the nozzle plane sweeper.

3. The liquid ejecting apparatus according to claim 2, wherein the predetermined time is a time taken until part of the protruding liquid becomes viscous and is solidified.

4. A liquid ejecting apparatus including a liquid ejecting head with a plurality of nozzles that eject a liquid to a medium, the liquid ejecting apparatus comprising:

actuators disposed in the head, each of which causes an ejection operation for ejecting the liquid from one of the nozzles and a protrusion operation for keeping the liquid protruded from a nozzle plane in which the nozzles are disposed; and a controller having the protrusion operation performed for all nozzles after the liquid has been ejected to the medium.

* * * * *